United States Patent [19]

Hiraga et al.

[11] Patent Number: 4,784,827

[45] Date of Patent: Nov. 15, 1988

[54] NONMAGNETIC STEEL FOR CRYOGENIC USE

[75] Inventors: keijiro Hiraga, Yatabe; Keisuke Ishikawa, Shonan, both of Japan

[73] Assignee: National Research Institute of Metals, Tokyo, Japan

[21] Appl. No.: 913,002

[22] Filed: Sep. 29, 1986

Related U.S. Application Data

[63] Continuation-in-part of Ser. No. 837,764, Mar. 10, 1986, abandoned.

[30] Foreign Application Priority Data

Mar. 12, 1985 [JP] Japan ..... 60-47468

[51] Int. Cl.[4] ..... C22C 38/50

[52] U.S. Cl. ..... 420/47; 420/584

[58] Field of Search ..... 420/46, 47, 584, 586

[56] References Cited

U.S. PATENT DOCUMENTS 3,201,233 6/1962 Hull ..... 420/47

FOREIGN PATENT DOCUMENTS 464658 9/1975 U.S.S.R. ..... 420/47

*Primary Examiner*—Deborah Yee

*Attorney, Agent, or Firm*—Wenderoth, Lind & Ponack

[57] ABSTRACT

A nonmagnetic steel for cryogenic use consisting essentially of, by weight, 23.0 to 30.0% of Ni, 13.0 to 16.0% of Cr, 3.0 to 7.4% of Mn, 1.5 to 3.0% of Ti, 1.0 to 3.0% of Mo, and the remainder being Fe, said steel containing not more than 0.02% of C, not more than 0.005% of P, not more than 0.005% of S, not more than 0.2% of Si and not more than 0.002% of B as trace elemental impurities. In a preferred embodiment, it further comprises not more than 0.5% by weight of Al and/or not more than 0.5% by weight of V. The steel has high strength and toughness in a cryogenic environment and excellent weldability.

6 Claims, 2 Drawing Sheets

NONMAGNETIC STEEL FOR CRYOGENIC USE

This application is a continuation-in-part application of U.S. Ser. No. 837,764 filed on Mar. 10, 1986, now abandoned.

BACKGROUND OF THE INVENTION

1. Field of the Invention

This invention relates to nonmagnetic steels for use in cryogenic applications. More specifically, this invention pertains to nonmagnetic steels suitable for components in superconducting machinery to which a large static or dynamic load and a high electromagnetic force are applied at cryogenic temperatures below 20 K. Such components as mentioned above are, for example, a rotor of a superconducting rotating machine, a support for a superconducting magnet in a nuclear fusion reactor, and a cable jacket for superconductor in a large scale magnet.

2. Description of the Prior Art

With the development of cryogenic machinery utilizing superconductors, materials of higher performance have been required for use in such machinery. Particularly, the rotor and the magnetic support mentioned above are required to be nonmagnetic and have high strength both at room temperature (about 300 K.) and at cryogenic temperatures below 20 K. Since the scale and capacity of the cryogenic machinery have increased from experimental or prototype one to more practicable one, its main components have tended to be inevitably constructed by welding. Therefore, high strength and nonmagnetic alloys for use in such machinery should also have excellent weldability. Here, "excellent weldability" means that the alloy can be welded without weld defects such as HAZ (heat affected zone) fissuring or fusion zone cracking and the strength of the softened weld metal region can be restored to the level of the base material by post-weld heat-treatment without reheat cracking and reduction in ductility or toughness.

The A286 iron-base superalloy (Fe-26Ni-15Cr-2.2Ti-1.3Mo, Mn≦1.5, by weight percent) has been known as a material of this type [see, for example, E. N. C. Dalder, "Development of Forging and Heat-Treating Practices for AMS 5737 for Use at Liquid Helium Temperatures", Adv. in Cryogenic Eng., 28 (1982), pages 883–892].

This alloy meets the aforesaid requirement for the strength, i.e., the 0.2% yield strength of the alloy is 70 to 80 kg/mm$^2$ at room temperature and 90 to 100 kg/mm$^2$ at 4 K. which are about twice as high as those of AISI 300 series austenitic alloys. Since the alloy was, however, originally developed as a heat-resistant material, no consideration has been given to its weldability or its magnetic properties at cryogenic temperatures. In other words, the alloy has very poor weldability, and it is difficult to use it in cryogenic applications requiring weldability. In addition, though the austenite phase of the alloy is fully stable against $\alpha'$-martensitic transformation even at 4 K., the alloy has the disadvantage that it shows weak ferromagnetism at cryogenic temperatures owing to the magnetic transition of its austenitic matrix. [D. R. Muzyka, "The Metallurgy of Nickel-Iron Alloys", The Super Alloys edited by C. T. Sims and W. C. Hagel, John Wiley and Sons, N.Y. (1972), pages 113–142; J. A. Brooks et al., "Progress Toward a More Weldable A-286", Welding Research Supplement (June, 1974), pages 242–245; and J. A. Brooks, "Effect of Alloy Modifications on HAZ Cracking of A-286 Stainless Steel", Welding Journal, 53 (November 1974), pages 517-s–523-s].

JBK75 iron-base alloy (Fe-30Ni-15Cr-2.2Ti-1.3Mo, Mn≦0.1, by weight percent) was developed as an alloy having improved weldability [see, for example, W. A. Logsdon et al., "Cryogenic Fatigue Crack Growth Rate Properties of JBK-75 Base and Autogenous Gas Tungsten Arc Weld Metal", Adv. in Cryogenic Eng., 30 (1984), pages 349–358]. Since, however this alloy is a modified version of the alloy A286 with an extremely lowered Mn level and increased Ni content, the alloy shows stronger ferromagnetic behavior than that of the A286 at cryogenic temperatures below 20 K. The ferromagnetism of these Fe-Ni-Cr-Ti alloys is mainly due to their high Ni concentrations.

Besides the aforesaid alloys of which the main composition is Fe-Ni-Cr-Ti, it may be possible to use existing alloys containing Mn in a high concentration for the aforesaid purpose. If these alloys have such a composition that no δ-ferrite is formed in the base material or weld metal, they are advantageous over the aforesaid A286 and JBK15 in regard to the magnetic properties at cryogenic temperatures of the austenitic matrix.

One example of such alloys is a precipitation-hardenable elinver-type alloy (see USSR No. 464658). However, since this alloy has a low Cr concentration and a high Al concentration of about 1%, the hardening rate during aging is very high and the optimum aging time is several hours at 700° to 750° C. It is not suitable, therefore, for use for a superconducting cable jacket or large scale structural components. Moreover, the age hardening characteristics of the alloy and lack in the consideration for trace elements such as C, P, S, Si, and B result in very poor weldability, i.e., the alloy is highly susceptible to hot-crackng by welding and reheat cracking upon post-weld heat-treatment.

Another example is a series of heat-resistant alloys of which main composition is Fe-Ni-Cr-Mn-Ti (see U.S. Pat. No. 3,201,233). As will be shown below, if the concentrations of the respective trace elements is tightly controlled as in the case of this invention, some of these alloys may have a possibility to show similar magnetic and mechanical properties at cryogenic temperatures to those of the alloy of this invention. The ductility at cryogenic temperatures of the alloys, however, is lower than that of the alloy of this invention and tends to decrease with an increase in their Mn concentration. Furthermore, these alloys has the disadvantage that the cellular precipitation of $\eta$-$Ni_3Ti$ occurs in the weld metal region of their weldament by post-weld heat-treatment comprising solutionizing and aging. This precipitation markedly reduces the ductility and toughness of the weldament at cryogenic temperatures.

SUMMARY OF THE INVENTION

It is the object of this invention to provide a nonmagnetic and weldable high-strength steel for cryogenic use. The alloy of this invention is nonmagnetic at even cryogenic temperatures below 20 K. and has excellent ductility and toughness at room and cryogenic temperatures. The alloy of this invention can be welded without hotcracking such as HAZ fissuring and fusion zone cracking. The strength of the weldment of this alloy can be close to the level of the base material by post-weld heat-treatment comprising solutionizing and aging without reheat cracking and harmful precipitation reaction which cause reduction in ductility and toughness at cryogenic temperatures.

According to this invention, there is provided a nonmagnetic steel for cryogenic use consisting essentially of, by weight, 23.0 to 30.0% of Ni, 13.0 to 16.0% of Cr, 3.0 to 7.4% of Mn, 1.5 to 3.0% of Ti, 1.0 to 3.0% of Mo, and the remainder being Fe, said steel containing not more than 0.02% of C, not more than 0.005% of P, not more than 0.005% of S, not more than 0.2% of Si and not more than 0.002% of B as trace elemental impurities.

In a preferred embodiment, the steel of this invention further contains not more than 0.5% by weight of Al and/or not more than 0.5% of V.

DETAILED DESCRIPTION OF THE INVENTION

Figure 1:
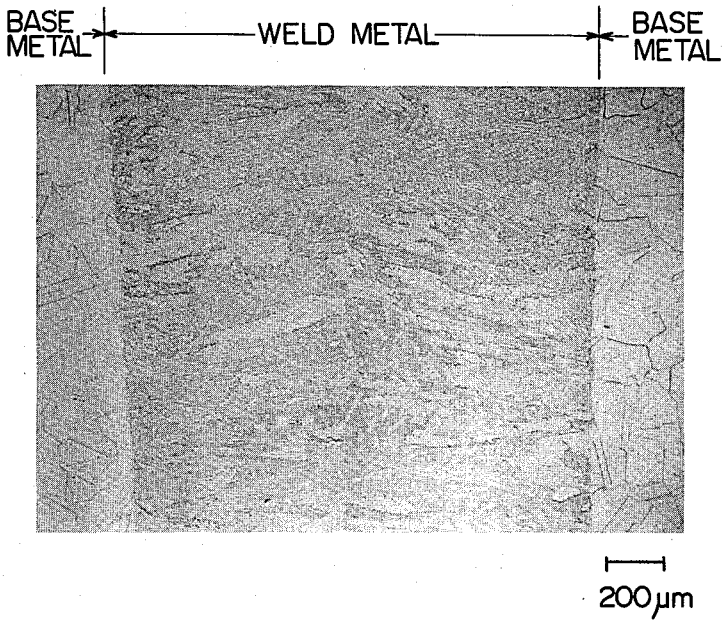
FIG. 1 is an optical micrograph which shows the structure of the weld metal region of an alloy of this invention having the composition Fe-27Ni-14Cr-6Mn-2.2Ti-0.1Al-1.4Mo.

We have now found that, by adding 3.0 to 7.4% by weight of Mn to a base composition of Fe-(23–30)Ni-(13–16)Cr-(1.5–3)Ti-(1–3)Mo (by weight percent), the alloy can be prevented from ferromagnetism at cryogenic temperatures. In a preferred embodiment, there is provided a nonmagnetic steel for cryogenic use consisting essentially of Fe-(23–28)Ni-(13.5–16)Cr-(1.5–2.5)Ti-(1–3)Mo and 3–7.0% by weight of Mn.

It is further necessary that trace elemental impurities in this alloy should be C≦0.02% by weight, P≦0.005% by weight, S≦0.005% by weight, Si≦0.2% by weight, and B≦0.002% by weight. It has been found that if the concentration of these trace elements exceeds the respective specified upper limits, the weldability and low temperature toughness of the resulting alloy are reduced. It has also been found that the alloy may further contain not more than 0.5% by weight of Al as a deoxidizing or strengthening element and/or not more than 0.5% by weight of V for fixation of dissolved carbon or improved hot workability.

The reasons for the above composition ranges are as follows:

If the proportion of Ni is less than 23.0% by weight, a stable austenitic phase cannot be retained at cryogenic temperatures, and brittle phases such as chi ($\chi$), sigma ($\sigma$), and ferromagnetic delta ($\delta$) phases are formed in the weld metal regions of as-welded and heat-treated weldments, which results in reduction in the low temperature ductility and toughness of the weldments. If the proportion of Ni exceeds 30.0% by weight, the austenitic matrix of the alloy shows ferromagnetism at cryogenic temperatures.

If the proportion of Cr is less than 13.0% by weight, the stability of the austenitic phase is reduced and low temperature magnetization of the austenitic matrix is increased. If it exceeds 16.0% by weight, brittle phases are formed in a weld metal region as in the case of the alloy with lower Ni content, and the low-temperature ductility and toughness of the weldment of the alloy is reduced.

If the proportion of Mn is less than 3.0% by weight, the alloy becomes ferromagnetic at cryogenic temperatures below 20 K. If it exceeds 7.4% by weight, the cellular precipitation of $\eta$-$Ni_3Ti$ occurs in the weld metal region by post-weld heat-treatment and the ductility and toughness at cryogenic temperatures of the weldment are markedly reduced. Furthermore, if the proportion of Mn exceeds 7.4% by weight, the ductility at cryogenic temperatures of the base material of the alloy is decreased with the increase in the Mn content. If the amount of Mn further increases, the same brittle phases as mentioned above are also formed in the weld metal region.

If the proportion of Ti is less than 1.5% by weight, the alloy cannot be strengthened by aging treatment. If it exceeds 3% by weight, brittle phases mentioned above are formed in the weld metal both in as-welded and heat-treated conditions and the ductility and toughness at cryogenic temperatures of the weldment (of the alloy) is reduced.

If the proportion of Mo is less than 1% by weight, the cellular reaction occurs in the base and weld metals by aging, and the ductility and toughness at cryogenic temperatures of the base material and weldment of the alloy are reduced. If it exceeds 3% by weight, brittle phases such as chi ($\chi$) and Laves $Fe_2(Ti,Mo)$ are formed in weld metal regions and the low-temperature toughness is reduced.

When Al as a deoxidizing or strengthening element and/or V as an element for fixing dissolved carbon or improved hot workability is to be included in the alloy, the amount of Al or V should be not more than 0.5% by weight. Preferably, the amount of any of these elements should not exceed 0.2% by weight. If its amount exceeds this specified upper limit, brittle phases such as sigma ($\sigma$) are formed in the weld metal region, and the ductility and toughness of the weldment is reduced.

The respective amounts of C, P, S, Si and B should be minimized since they form carbides, silicides, borides or non-metallic inclusions which do not contribute to the strengthening of the alloy, but reduce its ductility and toughness at cryogenic temperatures. If the concentrations of these trace elements exceed the respective upper limits specified above, these elements segregate at the dendritic grain boundaries in the weld metal, and nonmetallic products with low melting point are formed. Consequently, the weldability and low-temperature ductility and toughness of the weldment are reduced.

The alloy of this invention exhibits the following excellent advantages.

(1) This alloy has high strength both at room temperature and at cryogenic temperatures below 20 K., and can be welded without defects. Furthermore, by post-weld heat-treatment comprising solutionizing and aging, the strength of the softened weld metal region of the alloy of this invention can be close to a level of the base material without reheat cracking and reduction in ductility and toughness at cryogenic temperatures. Hence, the high strength of the base material can be effectively utilized in the welded structural components for cryogenic applications.

(2) Since the amount of magnetization in the alloy induced under a high magnetic field at cryogenic temperatures is small, the alloy does not perturb the magnetic field nor generate a large electromagnetic force in the structural components of superconducting magnets and related machinery. By using this alloy, therefore, design stresses for the structural components can be set at a lower level than that for conventional iron base superalloys. This reduces the amount of structural materials and heat capacity of the components, which, in its turn, also reduces loads on a refrigerating system attached to the machinery.

(3) This alloy can be obtained at low costs because a specified amount of Mn is used as an element for making the alloys nonmagnetic and improving their weldability. In addition, conventional alloy manufacturing facilities can be directly applied to the production of alloys of the invention.

The following examples illustrate the present invention more specifically.

EXAMPLES 1-4 AND COMPARATIVE EXAMPLES 1-7

The alloys of Examples 1 to 4 had the composition Fe-(23-30)Ni-14Cr-(3-6)Mn-2.2Ti-1.4Mo-0.1Al as shown in Table 1. The alloys of Comparative Examples 1 to 5 had the above composition in which the amount of Mn, Ni or C was different.

The alloys contained not more than 0.005% of C, not more than 0.1% of Si, not more than 0.003% of P, not more than 0.005% of S and not more than 0.001% of B (by weight percent). A286 and JBK75 (Comparative Examples 6 and 7) in Table 1 are conventional alloys produced by the same way mentioned above and used as a comparison. The compositions of the conventional alloys A286 and JBK75 were typical ones described in ASTM A453 and U.S. Pat. No. 3,895,939, respectively.

The samples were each melted into 20 kg ingots under an argon atmosphere using a high-frequency vacuum melting furance. The ingots were soaked at 1100° C. for 1 hour and then immediately hot-forged and hot-rolled to 15 mm thick and 60 mm wide plates. The plates were reheated, and solution-treated at 700° C. for 1 hour followed by water quenching. In order to examine the age-hardening characteristics of the solution-treated alloys, Vickers hardness tests under a load of 10 kgf were carried out on the alloys aged at 700° C. It was found that the alloys in Table 1 show a maximum hardness of about 320-330Hv after aging at 700° C. for 40 hours. On the basis of this age hardening test, the above plates were aged at 700° C. for 40 hours in an argon atmosphere, and then water-cooled.

Low temperature mechanical and magnetic properties and weldability of the resulting alloys were tested by the following procedures:

(1) Tensile specimens (20 mm gauge length and 3.5 mm in diameter), Charpy specimens (JIS No. 4, 2 mm-V-notched) and cubic specimens (3 mm on one side) for magnetic measurement were cut from the respective aged plates. The V-notch of the Charpy specimens was oriented perpendicular to the hot-rolling direction. Tensile tests were carried out by immersing the specimens into liquid helium in a cryostat and by using an Instron-type testing machine at a strain rate of $1.7\times10^{-3}$/s.

For the Charpy impact test at 4 K., the specimens were enclosed in a 2 mm-tick polystyrene capsule having grooves, and liquid helium was injected into the capsule. This test was conducted in accordance with the method described by Ogata et al., "A Simple Method for Charpy Impact Test at Liquid Helium", in Iron and Steel, 6, 1983, pages 641-646.

Since the effect of the capsule upon absorbing energy of the specimen was less than 0.2 kgm, it can be neglected. The temperature of the specimen was determined by using a dummy specimen having a thermocouple inserted therein.

Magnetization curves at 4 K. were measured on a vibrating sample magnetometer equipped with a superconducting magnet in fields up to 75 kOe.

The temperature of the specimen was determined by a thermocouple kept into close contact with the sample.

The mechanical and magnetic properties at 4 K. of the products are shown in Table 1. The apparent saturation magnetization was estimated from the extrapolation of the high field linear sections of magnetization curves to a zero field.

TABLE 1

Mechanical and Magnetic Properties at 4K of Base Materials

| Example (Ex.) or a Comparative Example (CEx.) | Composition (% by weight) C | Mn | Ni | Mechanical properties at 4K* Strength $\sigma_{0.2}$ (kg/mm²) | $\sigma_B$ (kg/mm²) | Ductility $\epsilon$ (%) | Toughness vE (kg-m) | Magnetic properties at 4K Magnetization at a field of 75 KOe (G) | Apparent saturation magnetization (G) |
|---|---|---|---|---|---|---|---|---|---|
| Ex. 1 | ≦0.005 | 3 | 23 | 95 | 158 | 42.6 | 15.4 | 61 | 5 |
| Ex. 2 | " | 7 | 23 | 95 | 155 | 41.0 | 15.6 | 33 | ≦1.0 |
| Ex. 3 | " | 6 | 27 | 96 | 159 | 43.1 | 15.7 | 45 | " |
| Ex. 4 | " | 6 | 30 | 97 | 160 | 42.1 | 15.6 | 52 | " |
| CEx. 1 | 0.025 | 6 | 27 | 99 | 154 | 23.2 | 5.5 | 47 | " |
| CEx. 2 | ≦0.005 | 8.5 | 27 | 97 | 155 | 27.1 | 15.2 | 37 | " |
| CEx. 3 | " | 12 | 27 | 95 | 157 | 20.0 | 16.1 | 28 | " |
| CEx. 4 | " | 12 | 30 | 95 | 158 | 21.2 | 15.5 | 32 | " |
| CEx. 5 | " | 15 | 30 | 96 | 157 | 15.3 | 15.4 | 26 | " |
| CEx. 6 (A286) | 0.02 | 1.5 | 26 | 96 | 158 | 25.0 | 6.2 | 141 | 92 |
| CEx. 7 (JBK75) | 0.012 | 0.05 | 30 | 96 | 159 | 32.3 | 16.1 | 216 | 166 |

*$\sigma_{0.2}$: 0.2% yield strength
$\sigma_B$: tensile strength
$\epsilon$: total elongation
vE: Charpy absorbed energy It is seen from Table 1 that the nonmagnetic steels for cryogenic use in accordance with this invention have high strength equivalent to those of conventional A286 and JBK75 alloys (Comparative Examples 6 and 7). A286 and JBK75 were determined to be ferromagnetic at 4 K. as a result of analysis of the Arrott plot ($M^2$ vs H/M plots) of their magnetization curves, and the induced magnetization in the alloys at 75 KOe was high. In contrast, the alloys of this invention were determined to be non-ferromagnetic by the same analysis, and the induced magnetization in the alloys was much lower than that of A286 or JBK75. Hence, the alloys of this invention are shown to have excellent magnetic characteristics.

The alloys of Comparative Examples 2 to 5 having a higher Mn content than the alloys of the invention have better magnetic properties than A286 and JBK75, but inferior ductility at cryogenic temperatures to the alloys of the invention. In the alloy of Comparative Example 5, slight cellular precipitation occurred, and its ductility was inferior to the other alloys of Comparative Examples. The alloy of Comparative Example 1 which is a high carbon version of the alloys of this invention has much lower ductility and toughness at cryogenic temperatures than the alloys of this invention (Ex. 1 to Ex. 4).

(2) The oxidized scale on the surface of the aged plates (15×60×200 mm) obtained as above were removed by surface machining, and bead on plate electron beam welding at a beam voltage of 50 kV, a beam current of 170 mmA, and travel speed in 125 cm/min. was carried out along the longitudinal direction on the center of each plate.

The post-weld heat-treatment which consist of solutionizing at 1100° C. for 1 hour followed by water quenching and aging at 700° C. for 40 hours was carried out on the halves of the respective welded plates. Specimens for microstructural analysis were cut from the as-welded and heat-treated weldments perpendicular to the welding direction. The cut end surface of the specimens was polished and corroded, and then observed by using an optical microscpe. Tensile and Charpy specimens having the same configurations as those for the base material were also machined from the as-welded and heat-treated weldments. These specimens were oriented perpendicular to the welding direction (i.e., the hot rolling direction). The weld metal was centered on the gauge length of the tensile specimens. The 2 mm-v-Notch for the Charpy specimens was cut along the welding direction and on the center of the weld metal region. The tests were carried out in the same way as in the csse of the base material.

The results obtained are shown in Table 2. Typical microstructures of the weld metal region of the as-welded and heat-treated weldments are also shown in FIGS. 1 to 4.

Figure 2:
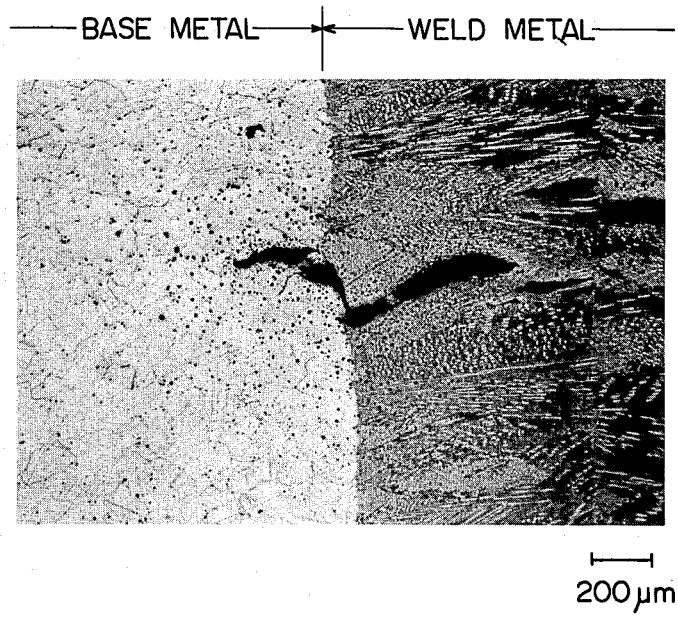
FIG. 2 is an optical micrograph which shows the structure of the A286 iron base superalloy.
Figure 3:
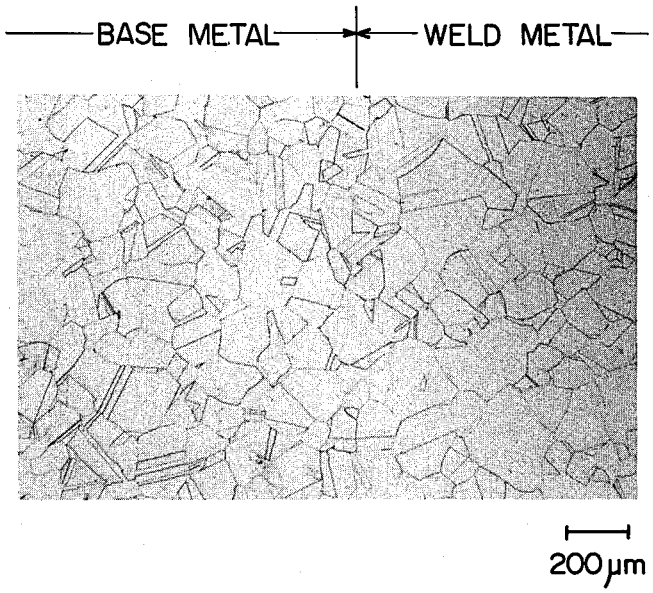
FIG. 3 is an optical micrograph which shows the structure of the weld metal region of the alloy of this invention after post-weld heat-treatment (solutionized at 1100° C. for 1 hour followed by water quenching and then aged at 700° C. for 40 hours.) The composition of the alloy is Fe-27Ni-14Cr-6Mn-2.2Ti-0.1Al-1.4Mo (same as that shown in FIG. 1).
Figure 4:
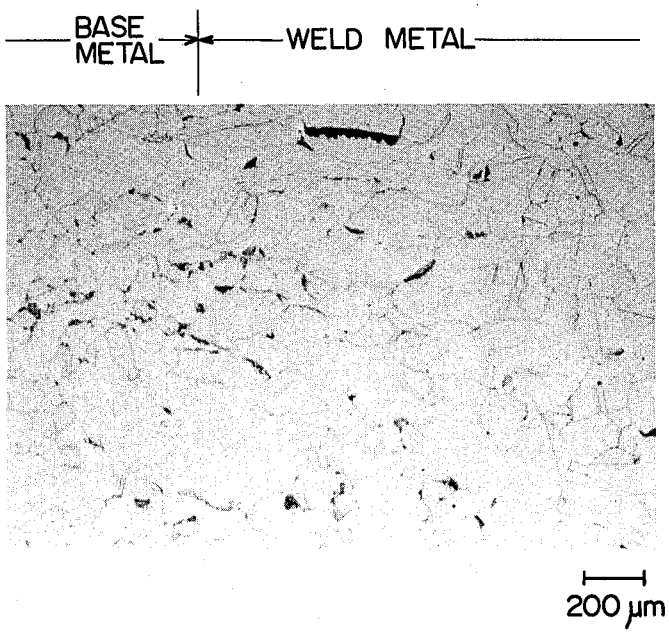
FIG. 4 is an optical micrograph showing the structure of the weld metal region of an alloy having the composition of Fe-30Ni-14Cr-12Mn-2.2Ti-0.1Al-1.4Mo after the same post-weld heat-treatment as that in FIG. 3. The dark flecks are cellular precipitates.

FIG. 1 shows the weld metal region of the alloy of this invention (Ex. 3) which was free from weld defects. FIG. 3 shows the weld metal region of the alloy of this invention after the post-weld heat-treatment. The weld metal is recrystallized and no reheat cracking or brittle phases (i.e., cellular precipitates, sigma phase, chi phase, and Laves phase) was formed. FIG. 2 shows the weld metal region of the alloy A286 (CEx. 6), hot-cracking was formed in the HAZ and weld metal region. FIG. 4 shows the weld metal region of CEx. 4 after the post-weld heat-treatment, cellular precipitation occurs both in the base and weld metals.

TABLE 2

Weldability and Mechanical Properties of 4K of Weldments

| Example (Ex.) or Comparative Example (CEx.) | Composition (% by weight) C | Mn | Ni | Weldment: Welding defects | Mechanical properties at 4K: Strength $\sigma_{0.2}$ (kg/mm²) | $\sigma_B$ (kg/mm²) | Ductility $\epsilon$ (%) | Toughness vE (kg-m) |
|---|---|---|---|---|---|---|---|---|
| Ex. 1 | ≦0.005 | 3 | 23 | Not observed | 78 | 114 | 11.1 | 21.7 |
| Ex. 2 | " | 7 | 23 | " | 80 | 112 | 13.9 | 20.1 |
| Ex. 3 | " | 6 | 27 | " | 78 | 111 | 11.2 | 21.9 |
| Ex. 4 | " | 6 | 30 | " | 81 | 111 | 10.5 | 22.1 |
| CEx. 1 | 0.025 | 6 | 27 | Cracking occurred | 79 | 105 | 5.8 | 6.1 |
| CEx. 2 | ≦0.005 | 8.5 | 27 | Not observed | 77 | 113 | 10.0 | 22.1 |
| CEx. 3 | " | 12 | 27 | " | 78 | 112 | 9.8 | 22.0 |
| CEx. 4 | " | 12 | 30 | " | 79 | 109 | 9.9 | 21.5 |
| CEx. 5 | " | 15 | 30 | " | 78 | 107 | 9.5 | 21.0 |
| CEx. 6 (A286) | 0.02 | 1.5 | 26 | Cracking occurred | 83 | 112 | 4.8 | 0.8 |
| CEx. 7 (JBK75) | 0.012 | 0.05 | 30 | Not observed | 76 | 106 | 10.2 | 22.5 |

| Example (Ex.) or Comparative Example (CEx.) | Post-weld heat-treated weldment: Welding defects and/or reheat cracking | Cellular precipitation | Mechanical properties at 4K: Strength $\sigma_{0.2}$ (kg/mm²) | $\sigma_B$ (kg/mm²) | Ductility $\epsilon$ (%) | Toughness vE (kg-m) |
|---|---|---|---|---|---|---|
| Ex. 1 | Not observed | Not observed | 88 | 147 | 33.6 | 13.1 |
| Ex. 2 | " | " | 86 | 145 | 31.7 | 12.1 |
| Ex. 3 | " | " | 91 | 148 | 34.9 | 13.2 |
| Ex. 4 | " | " | 87 | 146 | 34.8 | 13.4 |
| CEx. 1 | Observed | " | 89 | 132 | 14.1 | 4.9 |
| CEx. 2 | Not observed | Observed | 86 | 141 | 23.5 | 8.1 |
| CEx. 3 | " | " | 85 | 139 | 17.2 | 7.2 |
| CEx. 4 | " | " | 85 | 139 | 18.9 | 7.4 |
| CEx. 5 | slightly observed | " | 84 | 136 | 16.3 | 6.5 |
| CEx. 6 (A286) | Observed | Not observed | 86 | 129 | 12.1 | 0.6 |
| CEx. 7 (JBK75) | Not observed | " | 86 | 148 | 35.0 | 13.9 |

It is clearly found from Table 2 and FIG. 1 that the nonmagnetic steel for cryogenic use in accordance with this invention can be welded without any HAZ microfissuring or fusion zone hot cracking and that both the base and the welded materials have high impact toughness even at 4 K.

The lower ductility of the as-welded materials than that of the base materials shown in Table 1 is due to the strain localization on the softened weld metal region during tensile tests.

As shown in FIG. 3, the post-weld heat-treatment which consists of solutionizing and aging can be successfully adopted to the weldment of the alloy of this invention without any reheat cracking and cellular precipitation. It is further found from Table 2 that the post-weld heat-treatment for the alloy of this invention can restore the strength of the weldment up to 90% or more of that of the base material. At the same time, the ductility of the weldment is also increased by the heat-treatment owing to reduction in the strength mismatch between the base metal and weld metal region.

In contrast with the alloys of this invention, the comparative alloy CEx. 1 which is a high C version of the alloy of this invention and CEx. 6 (conventional A286) are highly susceptible to the weld hot cracking as shown in FIG. 2. Though comparative alloys CEx. 2 to CEx. 5 which are higher Mn versions of the alloy of this invention can be welded without such hot cracking, the cellular precipitation as shown in FIG. 4 is formed in the weld metal region by the post-weld heat-treatment and the ductility and toughness at 4 K. of the weldment are diminished. Furthermore, for the highest Mn alloy (CEx. 5), a small amount of reheat cracking is formed at the weld metal by the heat-treatment. The comparative alloy CEx. 7 shows a good weldability, but the alloy is ferromagnetic at 4 K. as mentioned before.

EXAMPLES 7–8

Alloys including 0.1% by weight of Al or 0.1% by weight of V in addition to the compositions shown in Examples 1 and 4 were produced in the same way as in Examples 1 and 4. These alloys were subjected to an age-hardening test, a tensile test, electron beam welding, and a Charpy impact test in the same way as in Examples 1 and 3 to 6. These alloys had slightly higher strengths than the alloys obtained in Examples 1 and 4, but showed almost the same magnetic properties, weldability and toughness as did the latter.

What is claimed is:

1. A nonmagnetic steel for cryogenic use consisting essentially of, by weight, 23.0 to 30.0% of Ni, 13.0 to 16.0% of Cr, 3.0 to 7.0% of Mn, 1.5 to 3.0% of Ti, 1.0 to 3.0% of Mo, and the remainder being Fe, said steel containing as trace elemental impurities not more than 0.02% of C, not more than 0.005% of P, nor more than 0.005% of S, not more than 0.2% of Si, not more than 0.5% by weight of Al and not more than 0.002% of B.

2. The nonmagnetic steel of claim 1 which further comprises not more than 0.5% by weight of V.

3. The nonmagnetic steel of claim 1 which comprises, by weight, 23.0 to 28.0% of Ni, 13.5 to 16.0% of Cr, 3.0 to 7.0% of Mn, 1.5 to 2.5% of Ti, and 1.0 to 3.0% of Mo.

4. The nonmagnetic steel of claim 3 which further comprises not more than 0.2% by weight of Al and/or not more than 0.2% by weight of V.

5. The nonmagnetic steel of claim 3 which comprises not more than 0.01% by weight of C.

6. The nonmagnetic steel of claim 4 which comprises not more than 0.01% by weight of C.

* * * * *